US009543639B2

(12) United States Patent
Iellici et al.

(10) Patent No.: US 9,543,639 B2
(45) Date of Patent: Jan. 10, 2017

(54) BACK FACE ANTENNA IN A COMPUTING DEVICE CASE

(71) Applicant: Microsoft Corporation, Redmond, WA (US)

(72) Inventors: Devis Iellici, Cambridge (GB); Marc Harper, Issaquah, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 270 days.

(21) Appl. No.: 14/090,465

(22) Filed: Nov. 26, 2013

(65) Prior Publication Data

US 2014/0347226 A1 Nov. 27, 2014

Related U.S. Application Data

(60) Provisional application No. 61/827,372, filed on May 24, 2013, provisional application No. 61/827,421, filed on May 24, 2013.

(51) Int. Cl.
*H01Q 1/24* (2006.01)
*H01Q 1/22* (2006.01)
(Continued)

(52) U.S. Cl.
CPC ..... *H01Q 1/243* (2013.01); *H01Q 1/2266* (2013.01); *H01Q 5/371* (2015.01); *H01Q 5/378* (2015.01);
(Continued)

(58) Field of Classification Search
CPC ..... H01Q 1/243; H01Q 13/10; H01Q 1/2266; H01Q 5/371; H01Q 9/42
(Continued)

(56) References Cited

U.S. PATENT DOCUMENTS 4,518,965 A * 5/1985 Hidaka ..... H01Q 1/38 343/742
4,625,212 A 11/1986 Oda et al.
(Continued)

FOREIGN PATENT DOCUMENTS

EP 2405534 A1 11/2012
GB 2409345 A 6/2005
(Continued)

OTHER PUBLICATIONS

Petosa, A. et al, "Dielectric Resonator Antennas: A Historical Review and the Current State of Art", Antennas and Propagation Magazine, IEEE, (vol. 52, Issue 5) Oct. 2010, pp. 91-116.
(Continued)

*Primary Examiner* — Tho G Phan
(74) *Attorney, Agent, or Firm* — Brandon Roper; Judy Yee; Micky Minhas

(57) ABSTRACT

An antenna assembly includes a portion of the metal computing device case as a primary radiating structure. The metal computing device case includes a back face and one or more side faces bounding the back face. The metal computing device case further includes a radiating structure having an aperture formed in the back face from which a notch extends from the aperture cutting through the back face and through at least one side face of the metal computing device case. A conductive feed structure is connected to a radio. The conductive feed structure is positioned proximal to the radiating structure of the metal computing device case and is configured to excite the radiating structure at one or more resonance frequencies.

20 Claims, 20 Drawing Sheets

(51) Int. Cl.

| | |
|---|---|
| ***H01Q 9/42*** | (2006.01) |
| ***H01Q 13/10*** | (2006.01) |
| ***H01Q 5/371*** | (2015.01) |
| ***H01Q 5/378*** | (2015.01) |

(52) U.S. Cl.
CPC ..... *H01Q 9/42* (2013.01); *H01Q 13/10* (2013.01); *Y10T 29/49016* (2015.01)

(58) Field of Classification Search
USPC ..... 343/702, 700 MS, 767, 770, 829, 846; 29/600
See application file for complete search history.

(56) References Cited

U.S. PATENT DOCUMENTS

| | | | | |
|---|---|---|---|---|
| 6,348,897 | B1 | 2/2002 | Alameh et al. | |
| 6,642,891 | B2 | 11/2003 | Baro | |
| 6,650,294 | B2 | 11/2003 | Ying et al. | |
| 7,084,814 | B2 | 8/2006 | Chen et al. | |
| 7,132,987 | B1 | 11/2006 | Olsson et al. | |
| 7,215,283 | B2 | 5/2007 | Boyle | |
| 7,321,337 | B2 | 1/2008 | Ikeda et al. | |
| 7,342,540 | B2 | 3/2008 | Nahar et al. | |
| 7,535,421 | B2 | 5/2009 | Tseng et al. | |
| 7,545,327 | B2 | 6/2009 | Iellici et al. | |
| 7,671,804 | B2 * | 3/2010 | Zhang | H01Q 1/243 343/700 MS |
| 7,705,786 | B2 | 4/2010 | Iellici | |
| 8,125,772 | B2 * | 2/2012 | Kim | G02F 1/133308 343/702 |
| 8,269,677 | B2 | 9/2012 | Guterman et al. | |
| 8,410,985 | B2 | 4/2013 | Mercer et al. | |
| 8,644,012 | B2 * | 2/2014 | Lee | G06F 1/162 343/702 |
| 8,648,752 | B2 | 2/2014 | Ramachandran et al. | |
| 8,963,785 | B2 | 2/2015 | Dong et al. | |
| 9,070,969 | B2 * | 6/2015 | Mow | H01Q 1/243 |
| 9,196,952 | B2 | 11/2015 | Tran et al. | |
| 9,197,270 | B2 | 11/2015 | Ying et al. | |
| 9,287,612 | B2 | 3/2016 | Bolin et al. | |
| 2003/0201945 | A1 | 10/2003 | Reece et al. | |
| 2004/0041734 | A1 | 3/2004 | Shiotsu et al. | |
| 2004/0222925 | A1 | 11/2004 | Fabrega-Sanchez et al. | |
| 2004/0257283 | A1 | 12/2004 | Asano et al. | |
| 2005/0085204 | A1 | 4/2005 | Poilasne et al. | |
| 2005/0146475 | A1 | 7/2005 | Bettner et al. | |
| 2006/0244663 | A1 | 11/2006 | Fleck et al. | |
| 2007/0120740 | A1 | 5/2007 | Iellici | |
| 2007/0210969 | A1 | 9/2007 | Vance | |
| 2008/0316115 | A1 | 12/2008 | Hill et al. | |
| 2009/0153412 | A1 | 6/2009 | Chiang et al. | |
| 2010/0053002 | A1 * | 3/2010 | Wojack | H01Q 9/42 343/702 |
| 2010/0214180 | A1 * | 8/2010 | Krogerus | H01Q 1/243 343/702 |
| 2010/0231481 | A1 * | 9/2010 | Chiang | H01Q 1/243 343/898 |
| 2010/0321253 | A1 | 12/2010 | Vazquez et al. | |
| 2011/0136447 | A1 * | 6/2011 | Pascolini | H01Q 1/243 455/90.2 |
| 2011/0241949 | A1 | 10/2011 | Nickel et al. | |
| 2012/0154223 | A1 | 6/2012 | Oh et al. | |
| 2012/0176280 | A1 | 7/2012 | Chen et al. | |
| 2012/0274522 | A1 | 11/2012 | Ayatollahi | |
| 2013/0021212 | A1 | 1/2013 | Lai et al. | |
| 2013/0082884 | A1 | 4/2013 | Gummalla | |
| 2013/0135150 | A1 | 5/2013 | Kenoun et al. | |
| 2013/0169486 | A1 | 7/2013 | Huang et al. | |
| 2013/0194138 | A1 * | 8/2013 | Hammond | H01Q 13/10 343/702 |
| 2014/0203974 | A1 | 7/2014 | Liu et al. | |
| 2014/0347225 | A1 | 11/2014 | Harper | |
| 2014/0347227 | A1 | 11/2014 | Iellici et al. | |

FOREIGN PATENT DOCUMENTS

| | | | |
|---|---|---|---|
| GB | 2410131 | A | 7/2005 |
| GB | 2476035 | A | 6/2011 |
| JP | 2007194995 | A | 8/2007 |
| WO | 2004091046 | A1 | 10/2004 |
| WO | 2005091430 | | 9/2005 |
| WO | 2006134402 | | 12/2006 |
| WO | 2010025023 | A2 | 3/2010 |

OTHER PUBLICATIONS

Lee, T.H. et al, "New Dielectric Resonator Antenna Design for Mobile Handsets", Mobile & Satellite Communications Research Center, University of Bradford, Bradford BD7 1DP, UK; www.researchgate.net/publication 228992335.

"Second Written Opinion Issued in PCT Patent Application No. PCT/US2014/039421", Mailed Date: Apr. 21, 2015, 8 Pages.

"International Preliminary Report on Patentability Issued in PCT/US2014/039416", Mailed Date: Aug. 3, 2015, 6 Pages.

International Searching Authority, U.S. Patent and Trademark Office, International Search Report for PCT/US2014/039421, dated Aug. 14, 2014, 6 pages.

International Searching Authority, U.S. Patent and Trademark Office; Written Opinion for PCT/US2014/039421, mailed Aug. 22, 2014, 7 pages.

"International Preliminary Report on Patentability Issued in PCT Patent Application No. PCT/US2014/039421", Mailed Date: Sep. 4, 2015, 6 Pages.

"International Preliminary Report of Patentability issued in PCT Application No. PCT/US2014/039416"; Mailed Date: Aug. 3, 2015, 6 pages.

Non-Final Office Action issued in U.S. Appl. No. 14/090,542, dated Nov. 20, 2015, 17 pages.

International Search Report and Written Opinion Received for Patent Application No. PCT/US2014/039416, mailed Sep. 19, 2014, 14 Pages.

Non-Final Office Action issued in U.S. Appl. No. 14/090,353, dated Jan. 4, 2016, 17 pages.

International Searching Authority, U.S. Patent and Trademark Office, Second Written Opinion for PCT/US2014/039426, mailed Apr. 14, 2015, 6 pages.

International Searching Authority, U.S Patent and Trademark Office, Second Written Opinion for PCT/US2014/039421, mailed Apr. 21, 2015, 8 pages.

International Preliminary Report on Patentability Issued in PCT Application No. PCT/US2014/039426, mailed Aug. 3, 2013, 7 pages.

International Search Report & Written Opinion for PCT/US2014/039426, mailed Sep. 10, 2014, 14 pages.

Non-Final Office Action issued in U.S. Appl. No. 14/090,542, dated May 17, 2016, 7 pages.

"International Search Report & Written Opinion for PCT Patent Application No. PCT/US2014/039426", Mailed Date: Sep. 10, 2014, 14 Pages.

* cited by examiner

BACK FACE ANTENNA IN A COMPUTING DEVICE CASE

CROSS-REFERENCE TO RELATED APPLICATIONS

The present application claims benefit to U.S. Provisional Application No. 61/827,372, filed on May 24, 2013 and entitled "Back Face Antenna for a Computing Device Case," and U.S. Provisional Application No. 61/827,421, filed on May 24, 2013 and entitled "Side Face Antenna for a Computing Device Case," both of which are specifically incorporated by reference for all that they disclose and teach.

The present application is also related to U.S. Application No. 14/090,542, filed concurrently herewith and entitled "Side Face Antenna for a Computing Device Case", and U.S. Application No. 14/090,353 filed concurrently herewith and entitled "Radiating Structure Formed as a Part of a Metal Computing Device Case", both of which are specifically incorporated by reference for all that they disclose and teach.

BACKGROUND

Antennas for computing devices present challenges relating to receiving and transmitting radio waves at one or more select frequencies. These challenges are magnified by a current trend of housing such computing devices (and their antennas) in metal cases, as the metal cases tend to shield incoming and outgoing radio waves. Some attempted solutions to mitigate this shielding problem introduce structural and manufacturing challenges into the design of the computing device.

SUMMARY

Implementations described and claimed herein address the foregoing problems by forming an antenna assembly that includes a portion of the metal computing device case as a primary radiating structure. The metal computing device case includes a back face and one or more side faces bounding at least a portion of the back face. The metal computing device case further includes a radiating structure having an aperture formed in the back face from which a notch extends from the aperture cutting through the back face and through at least one side face of the metal computing device case. A conductive feed structure is connected to a radio. The conductive feed structure is positioned proximal to the radiating structure of the metal computing device case and is configured to excite the radiating structure at one or more resonance frequencies.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

DETAILED DESCRIPTION

Figure 1:
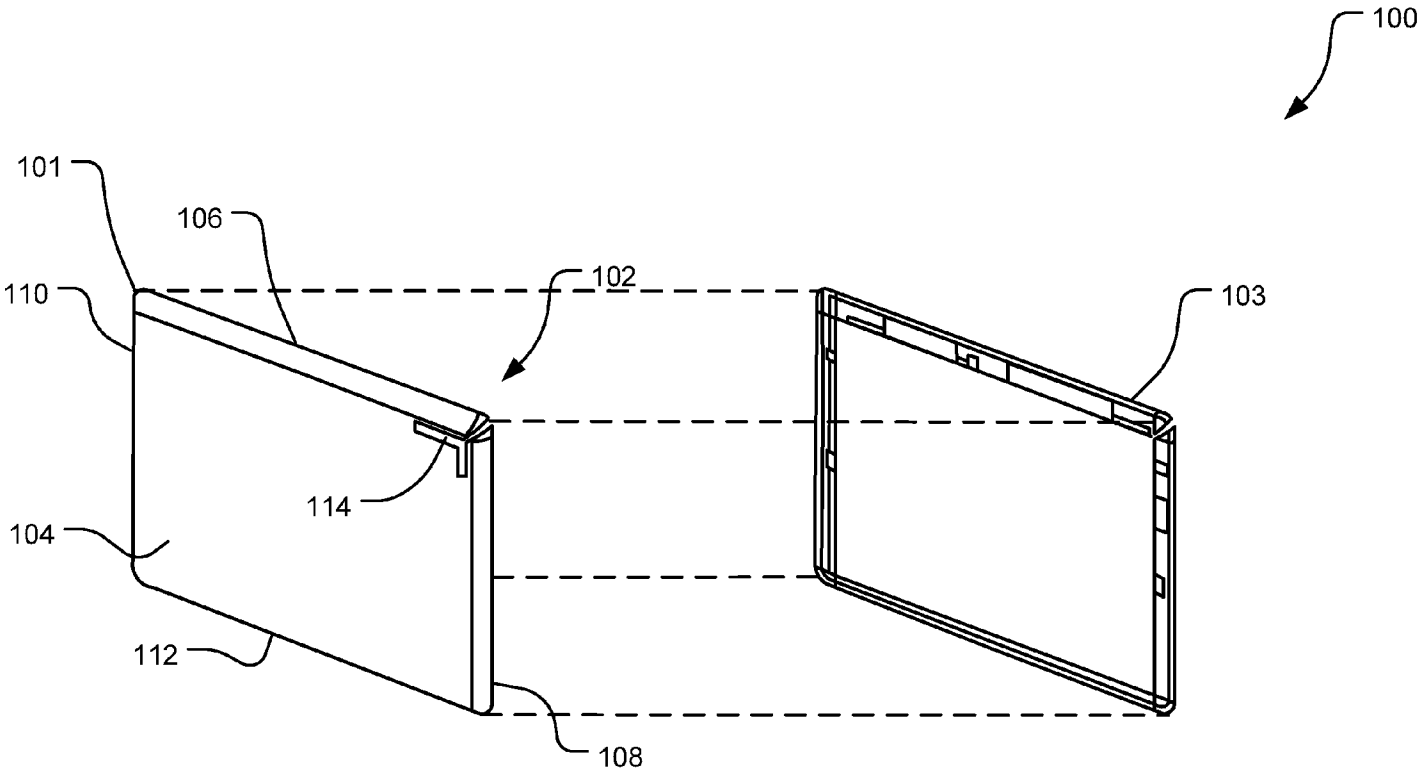
FIG. 1 illustrates two portions of an example metal computing device case having a back face antenna assembly.

FIG. 1 illustrates two portions 101 and 103 of an example metal computing device case 100 having a back face antenna assembly 102. The portion 103 typically contains a display assembly while the portion 101 typically encloses (at least partially) most other components of the computing device. In the illustrated implementation, the antenna assembly 102 is integrated as part of the metal computing device case 100.

The metal computing device case 100 includes a back face 104 and four side faces 106, 108, 110, and 112 bounding the back face 104. In other implementations, fewer than four sides may partially bound the back face 104. In addition, the back face 104 and one or more of the side faces may be joined at an abrupt corner, at a curved corner (e.g., a continuous arc between the back face and the side face), or in various continuous intersecting surface combinations. Furthermore, the side faces need not be perpendicular to the back face (e.g., a side face may be positioned at an obtuse or acute angle with the back face). In one implementation, the back face and one or more side faces are integrated into a single piece construction, although other assembled configurations are also contemplated.

The back face antenna assembly 102 includes at least one aperture, slot, or cut-out created in the back face 104. The aperture may also be referred to as a "slot." In FIG. 1, the cut-out is shown as L-shaped with segments parallel to two adjacent side faces of the computing device case 100, although other configurations are contemplated. The back face antenna assembly 102 also includes a notch is cut from the back face cut-out through the corner of two intersecting side face(s). The cut-out and notch form at least one elongated metal arm from the areas of the computing device case 100 surrounding the cut-out and notch, which collectively operates as a radiating structure of an antenna in combination with other elements, such as a feed structure. The elongated arm can be excited directly (e.g., galvanically, like a Planar Inverted -F Antenna), capacitively, or via some other excitation method. The cut-out and notch may be filled with a plastic layer or other insulating material (e.g., a ceramic other dielectric), as shown with a plastic insert 114, which may have a voltage-dependent dielectric constant. Such a radiating structure may be designed to resonate at a particular frequency, and/or, for certain applications, may be designed to radiate very limited, or substantially zero, power at a particular frequency or set of frequencies.

Figure 2:
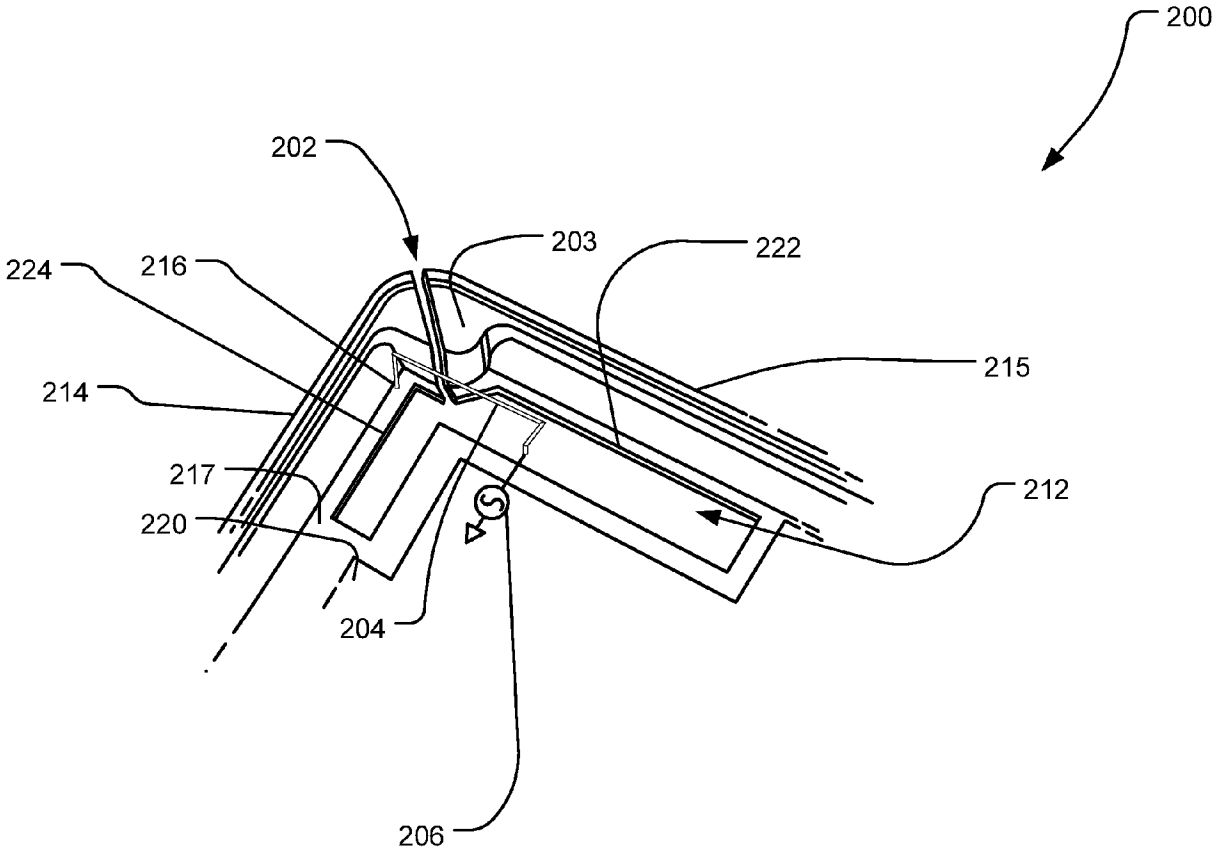
FIG. 2 illustrates an example L-shaped back face antenna assembly with a corner-located side face notch in a metal case of a computing device.

FIG. 2 illustrates an example L-shaped back face antenna assembly 200 with a corner-located side face notch 202 in a metal computing device case 203 of a computing device. A feed structure 204, in the form of a conductive wire or strip, connects a radio 206 at a connection point 216 to one of two elongated metal arms 214 and 215 formed along the edges of an L-shaped cut-out 212 (or two connected rectangular cut-out sections) in the back face 217 in combination with the side face notch 202.

The radio 206 may be mounted on a printed circuit board 220 (PCB) affixed to the back face 217 of the metal computing device case 203. Alternative connection configurations may also be employed (e.g., a connection to the other elongated metal arm). The notch 202 and the cut-out 212 may be filled with a plastic layer or other insulating material (e.g., a ceramic) (not shown).

The cut-out 212, the notch 202, and the elongated metal arms 214 and 215 operate as radiating structures of the antenna assembly 200. The dimensions of the cut-out sections influence the impedance matching for different radiofrequency bands. For example, the length of the cut-out section 222 provides a lower resonant frequency than the length of the cut-out section 224, thereby providing at least two radiofrequency bands supported by the antenna assembly 200. Likewise, the size and shape of the conductive feed structure 204 influences the resonance frequencies of the antenna assembly 200, especially when operated at higher frequencies as provided by the radio 206, as well as the impedance matching at the different radiofrequency bands.

Figure 3:
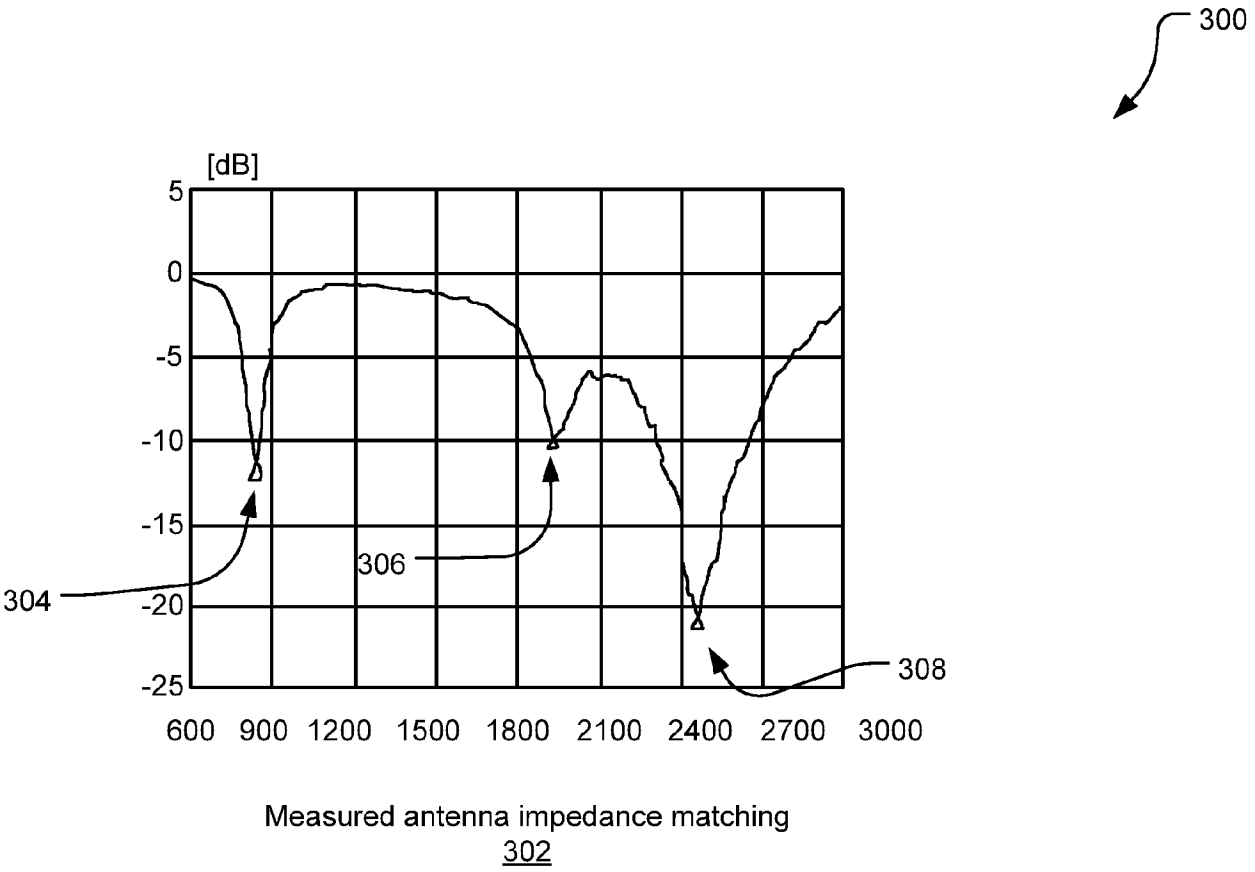
FIG. 3 illustrates example data relating to measured antenna impedance matching exhibited by an antenna assembly similar to that shown in FIG. 2.

FIG. 3 illustrates example data 300 relating to measured antenna impedance matching 302 exhibited by an antenna assembly similar to that shown in FIG. 2. Note the locally optimized impedance matching in the vicinity of 840 MHz, 1932 MHz, and 2454 MHz (see graph positions 304, 306, and 308 respectively), the first two of which substantially correspond to two GSM bands (850 MHz and 1900 MHz) and one WiFi band (2.4 GHz). Other cut -out, notch, and feed structure configurations can result in different impedance matched bands.

Figure 4:
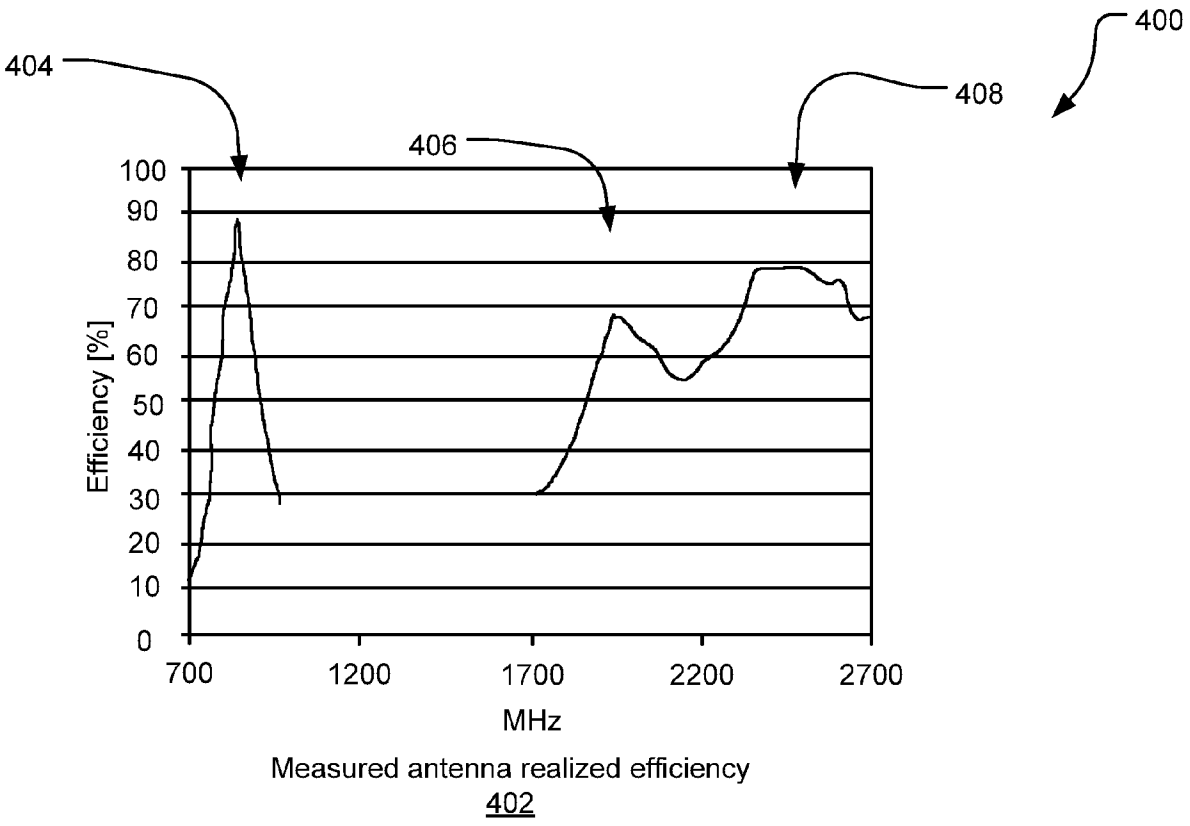
FIG. 4 illustrates example data relating to measured antenna realized efficiency exhibited by an antenna assembly similar to that shown in FIG. 2.

FIG. 4 illustrates example data 400 relating to measured antenna realized efficiency 402 exhibited by an antenna assembly similar to that shown in FIG. 2. Note the locally optimized efficiency peaks are positioned in the vicinity of 840 MHz, 1932 MHz, and 2454 MHz (see graph positions 404, 406, and 408 respectively), the first two of which substantially correspond to two GSM bands (850 MHz and 1900 MHz) and one WiFi band (2.4 GHz). Other cut-out, notch, and feed structure configurations can result in different antenna efficiency bands that may correspond with frequencies used in any radio standard or protocol including without limitation UMTS, GSM, LTE, 4G 3G, 2G WiFi, WiMAX, Bluetooth, Miracast, and other standards or specifications that may be developed in the future.

Figure 5:
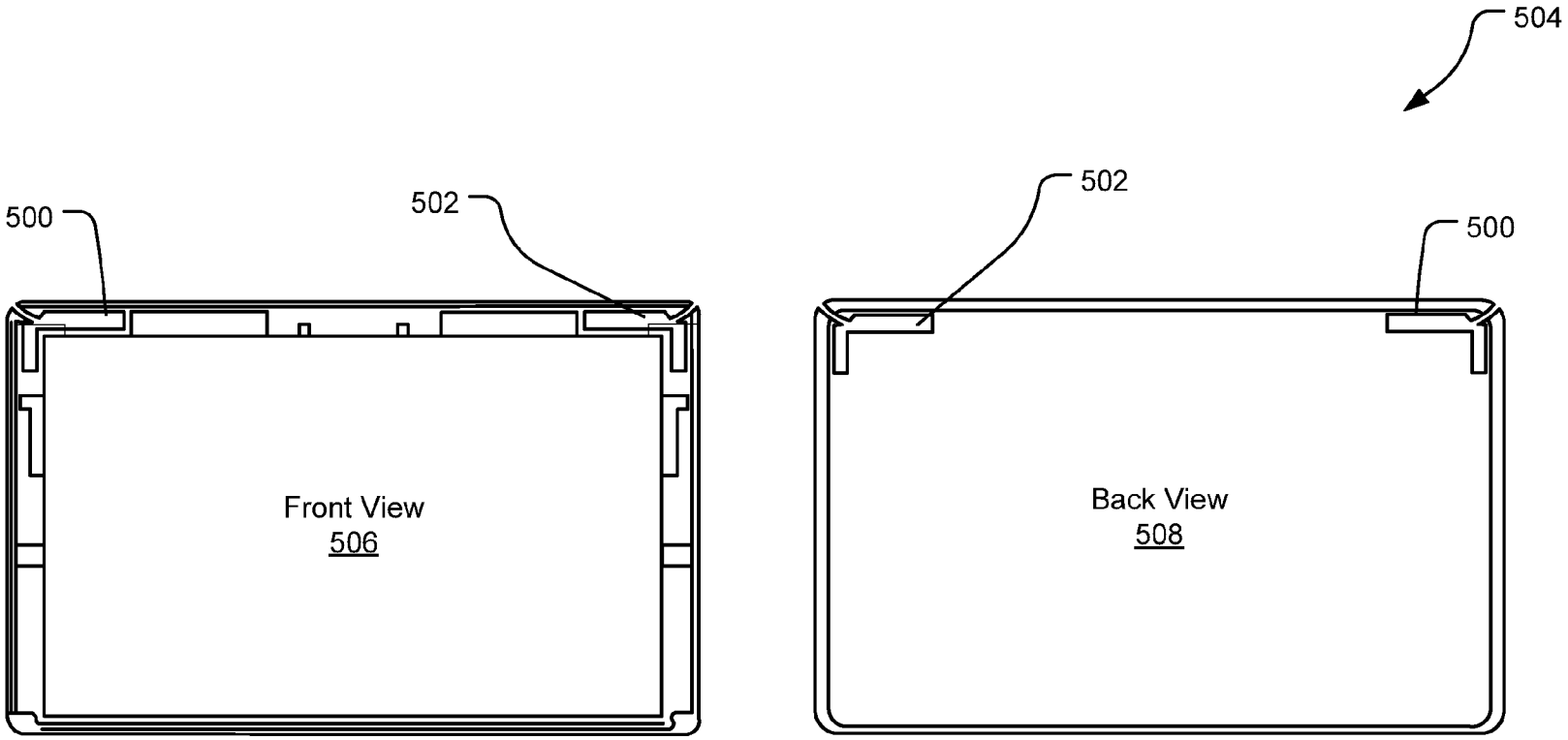
FIG. 5 illustrates multiple views (front view and back view) of an example metal computing device case having multiple back face antenna assemblies.

FIG. 5 illustrates multiple views (front view 506 and back view 508) of an example metal computing device case 504 having multiple back face antenna assemblies 500 and 502. The front view 506 shows the interior of the metal computing device case 504. It should be understood that more than four side face antenna assemblies may be configured in a single metal computing device case 504 (e.g., with some being in corners and others being along sides of the metal computing device case 504). Multiple antenna assemblies can be employed to provide a diversity/MIMO (multiple-input and multiple-output) configuration.

Figure 6:
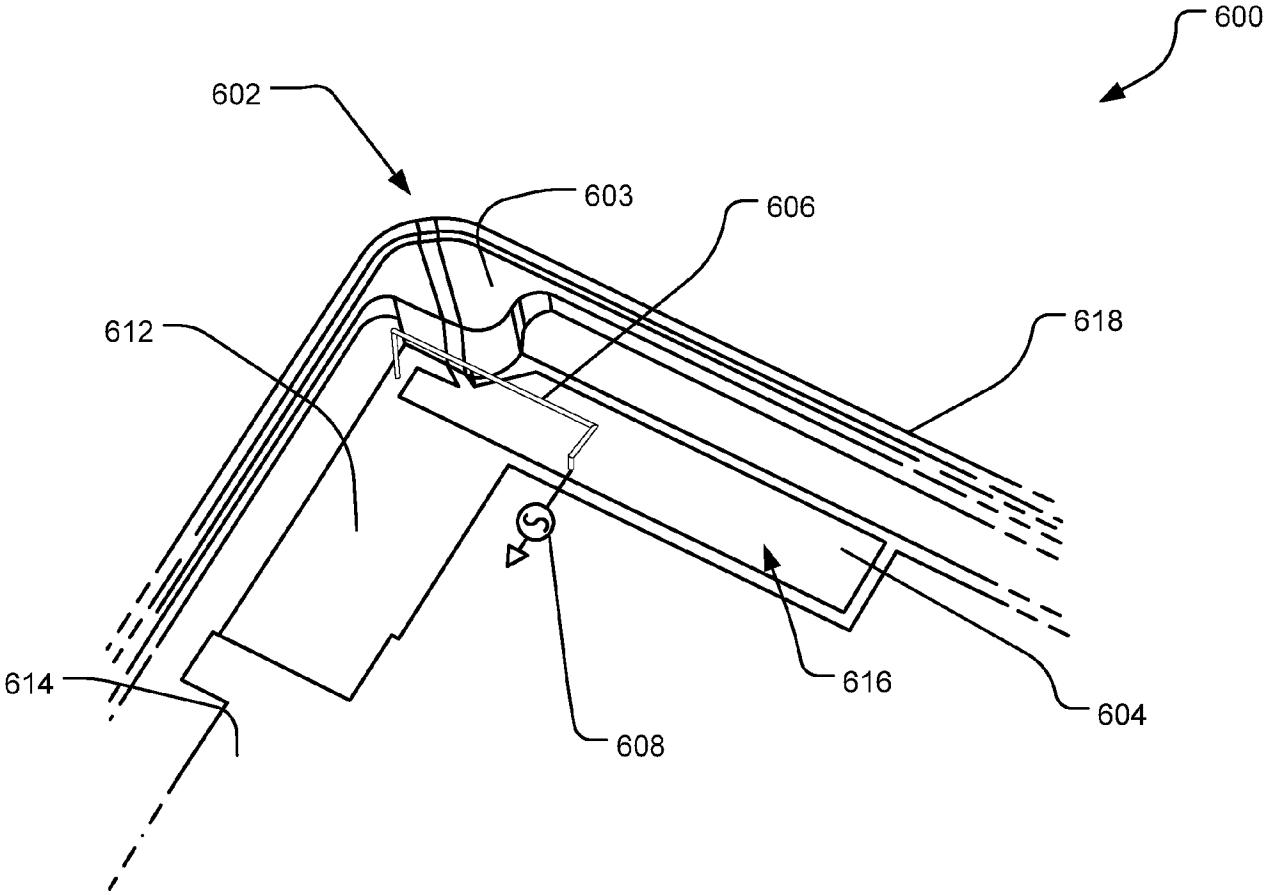
FIG. 6 illustrates an example back face antenna assembly with a non-L-shaped cut-out in a back face of a metal computing device case.

FIG. 6 illustrates an example back face antenna assembly 600 with a non-L-shaped cut-out 616 in a back face 612 of a metal computing device case 603. The cut-out 616 is filled with a plastic insert 604. It should be understood that the insert 604 may be made of other insulating materials (e.g., ceramics). A feed structure 606 connects a radio 608 to the back face 612. An elongated metal arm 618 is formed along an edge of the cut-out 616 in combination with a notch 602. Typically, the radio 608 is mounted on a PCB 614 within the metal computing device case 603.

The cut-out 616, the notch 602, and the elongated metal arm 618 operate as a radiating structure of the antenna assembly 600. The dimensions of the cut-out section influence the impedance matching for different radiofrequency bands. Likewise, the size and shape of the conductive feed structure 606 influences the resonance frequencies of the antenna assembly 600, especially when operated at higher frequencies as provided by the radio 608, as well as the impedance matching at the different radiofrequency bands.

Figure 7:
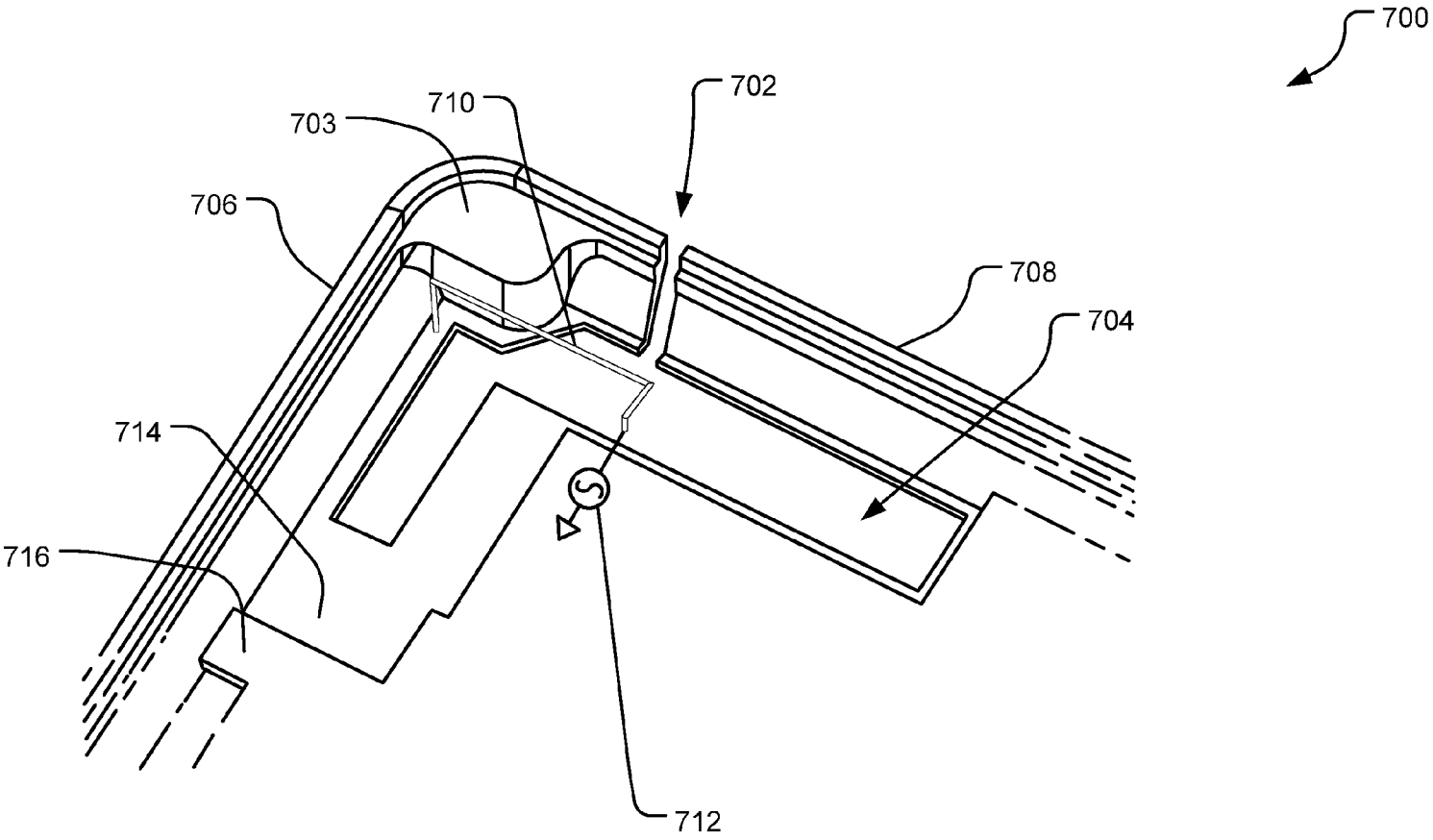
FIG. 7 illustrates an example L-shaped back face antenna assembly with a side-located side face notch in a metal computing device case.

FIG. 7 illustrates an example L-shaped back face antenna assembly 700 with a side-located side face notch 702 in a metal computing device case 703. An L-shaped cut-out 704 forms two elongated metal arms 706 and 708 along edges of the cut-out 704 in combination with a notch 702. A feed structure 710 connects a radio 712 to the back face 714. Typically, the radio 712 is mounted on a PCB 716 within the metal computing device case 703. It should be understood that the notch 702 may be formed in any side wall of the metal computing device case 703 that provides access to the cut-out 704.

Figure 8:
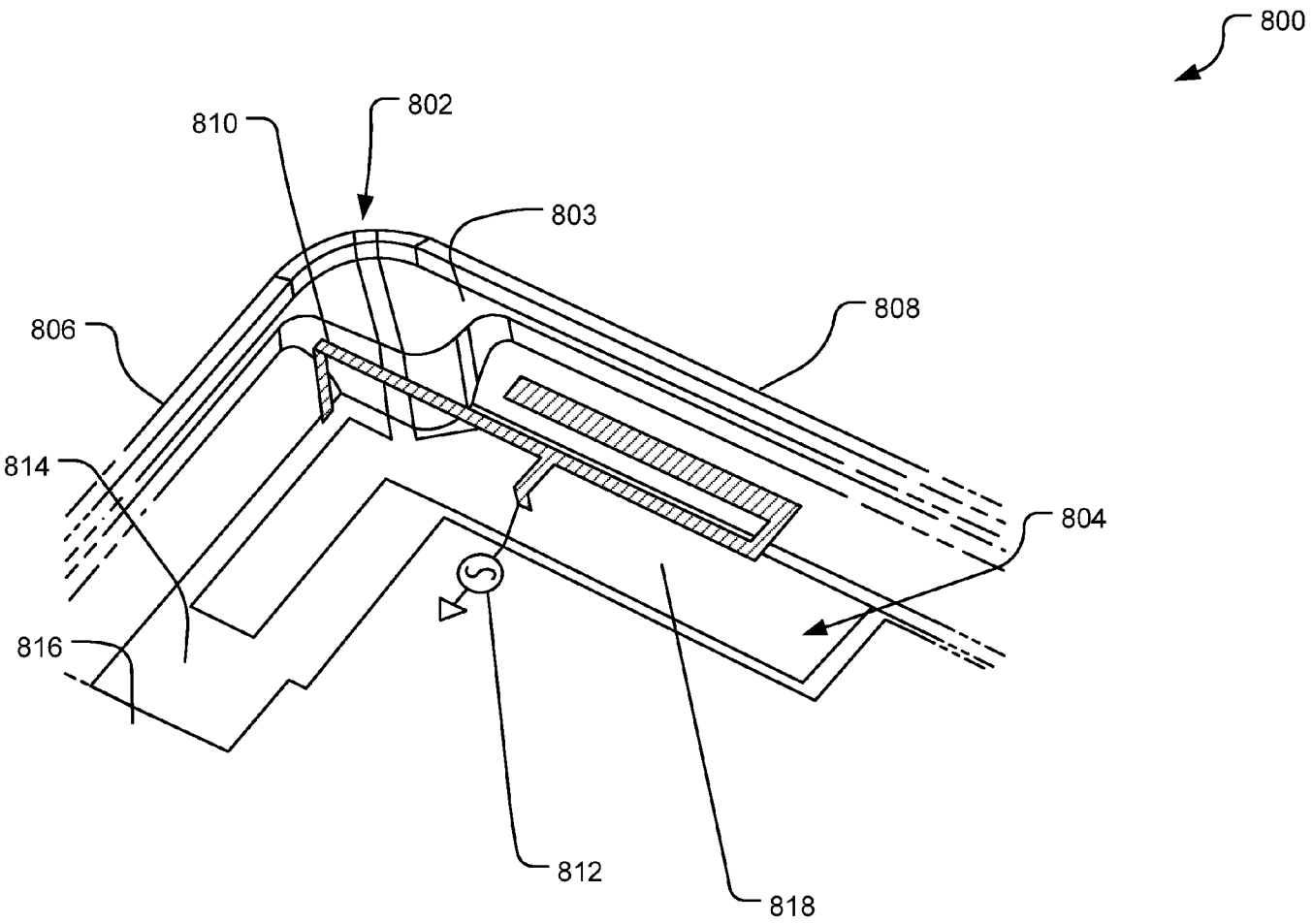
FIG. 8 illustrates an example L-shaped back face antenna assembly with a complex feed structure.

FIG. 8 illustrates an example L-shaped back face antenna assembly 800 with a complex feed structure 810. An L-shaped cut-out 804 forms two elongated metal arms 806 and 808 along edges of the cut-out 804 in combination with a notch 802. The feed structure 810 connects a radio 812 to the back face 814. The feed structure 810 has multiple branches to create multiple resonances at multiple frequencies or to enhance matching at certain frequencies. The feed structure 810 may be sized to achieve a particular resonance frequency and matching impedance. For example, the length, width, and/or thickness of each section of the feed structure 810 may be selected to achieve selected resonance frequencies and matching impedances. Further, the material of the feed structure 810 may be selected based on the resistance of a particular material to achieve selected resonance frequencies and matching impedances. Typically, the radio 812 is mounted on a PCB 816 within the metal computing device case 803. The cut-out 804 is filled with a plastic insert 818. It should be understood that the insert may be made of other insulating materials (e.g., ceramics).

Figure 9:
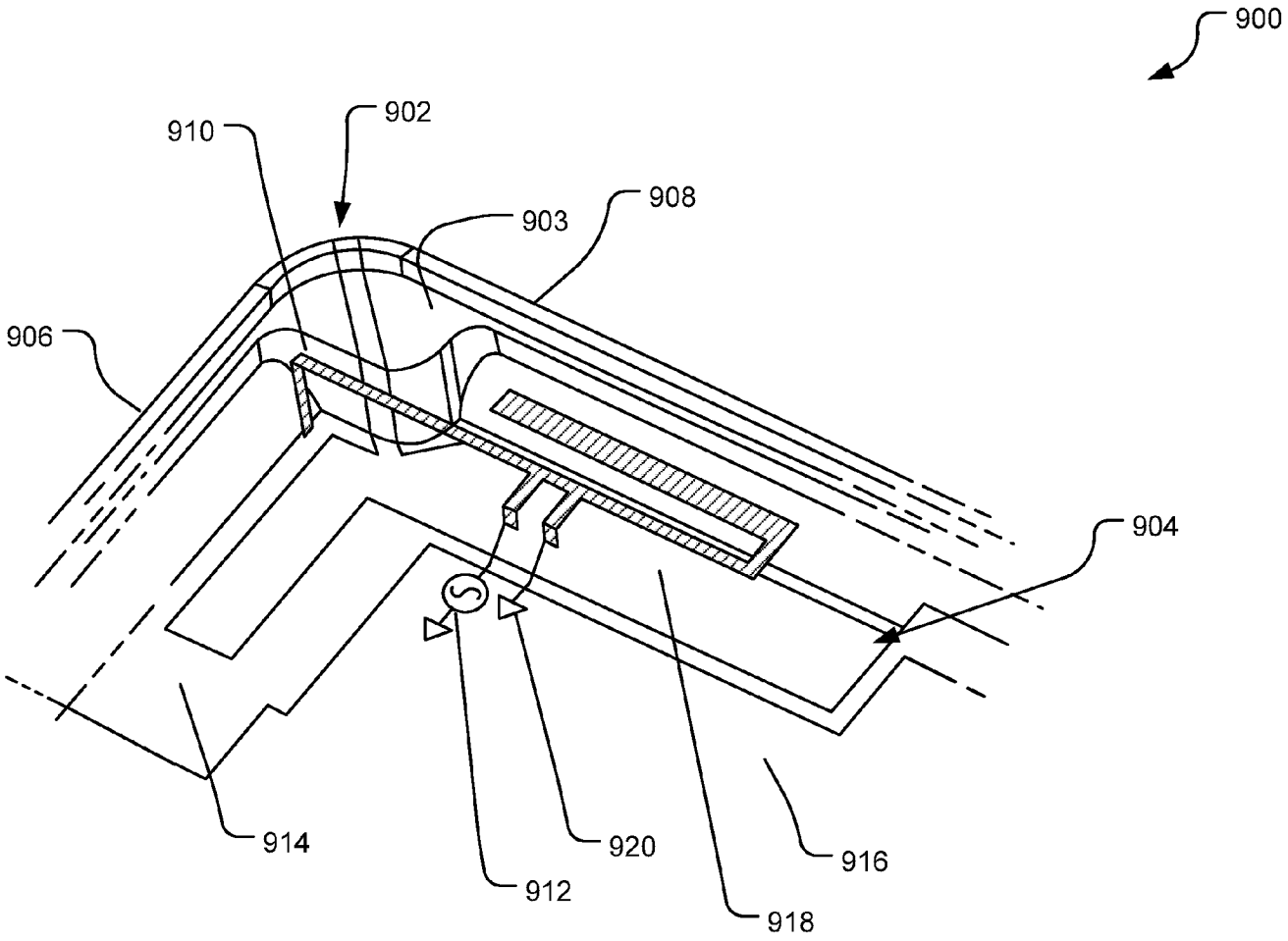
FIG. 9 illustrates an example L-shaped back face antenna assembly with a complex feed structure having a radio frequency ground positioned next to a radio.

FIG. 9 illustrates an example L-shaped back face antenna assembly 900 with a complex feed structure 910 having a radio frequency ground 920 (e.g., an electrically neutral potential) positioned next to a radio 912. An L-shaped cut-out 904 forms two elongated metal arms 906 and 908 along edges of the cut-out 904 in combination with a notch 902. The feed structure 910 electrically connects a radio 912 to the back face 914. The feed structure 910 has multiple branches to create multiple resonances at multiple frequencies or to enhance matching at certain frequencies. Typically, the radio 912 is mounted on a PCB 916 within the metal computing device case 903. The cut-out 904 is filled with a plastic insert 918. It should be understood that the insert may be made of other insulating materials (e.g., ceramics).

Figure 10:
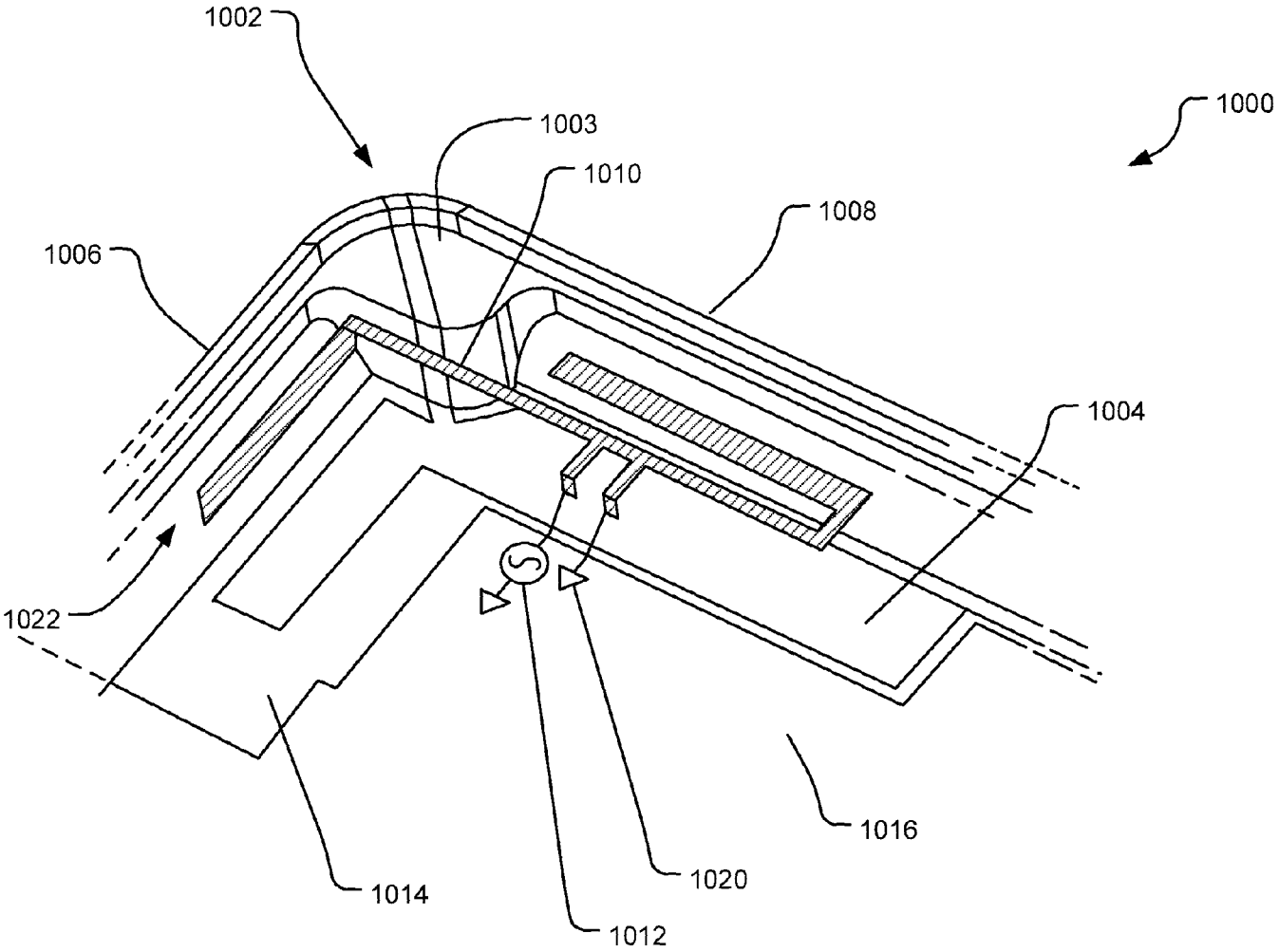
FIG. 10 illustrates an example L-shaped back face antenna assembly with a feed structure having capacitive coupling to a metal computing device case and a radio frequency ground positioned next to a radio.

FIG. 10 illustrates an example L-shaped back face antenna assembly 1000 with a feed structure 1010 having capacitive coupling to a metal computing device case 1003 and a radio frequency ground 1020 (e.g., an electrically neutral potential) positioned next to a radio 1012. An L-shaped cut-out 1004 forms two elongated metal arms 1006 and 1008 along edges of the cut-out 1004 in combination with a notch 1002. The feed structure 1010 capacitively couples a radio 1012 to the elongated metal arm 1006 of the metal computing device case 1003 across an insulating gap 1022. The feed structure 1010 has multiple branches to create multiple resonances at multiple frequencies or to enhance matching at certain frequencies. Typically, the radio 1012 and radio frequency ground 1020 is mounted on a PCB 1016 within the metal computing device case 1003.

Figure 11:
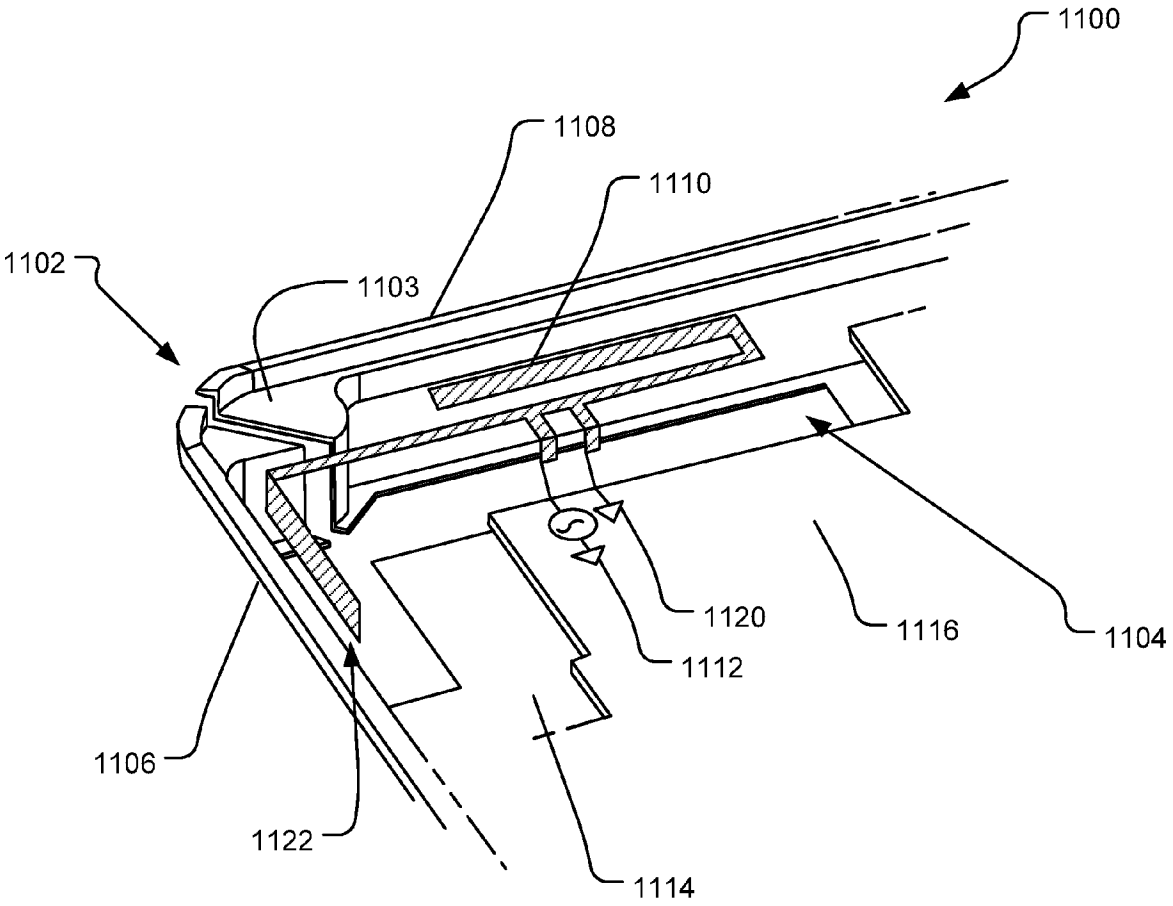
FIG. 11 illustrates an alternative view of an example L-shaped back face antenna assembly with a feed structure having capacitive coupling to a metal computing device case and a radio frequency ground positioned next to a radio.

FIG. 11 illustrates an alternative view of an example L-shaped back face antenna assembly 1100 with a feed structure 1110 having capacitive coupling to a metal computing device case 1103 and a radio frequency ground 1120 (e.g., an electrically neutral potential) positioned next to a radio 1112. An L-shaped cut-out 1104 in a back face 1114 of a metal computing device case 1103 forms two elongated metal arms 1106 and 1108 along edges of the cut-out 1104 in combination with a notch 1102. The feed structure 1110 capacitively couples a radio 1112 to the elongated metal arm 1106 of the metal computing device case 1103 across an insulating gap 1122. The feed structure 1110 has multiple branches to create multiple resonances at multiple frequencies or to enhance matching at certain frequencies. Typically, the radio 1112 and radio frequency ground 1120 is mounted on a PCB 1116 within the metal computing device case 1103.

Figure 12:
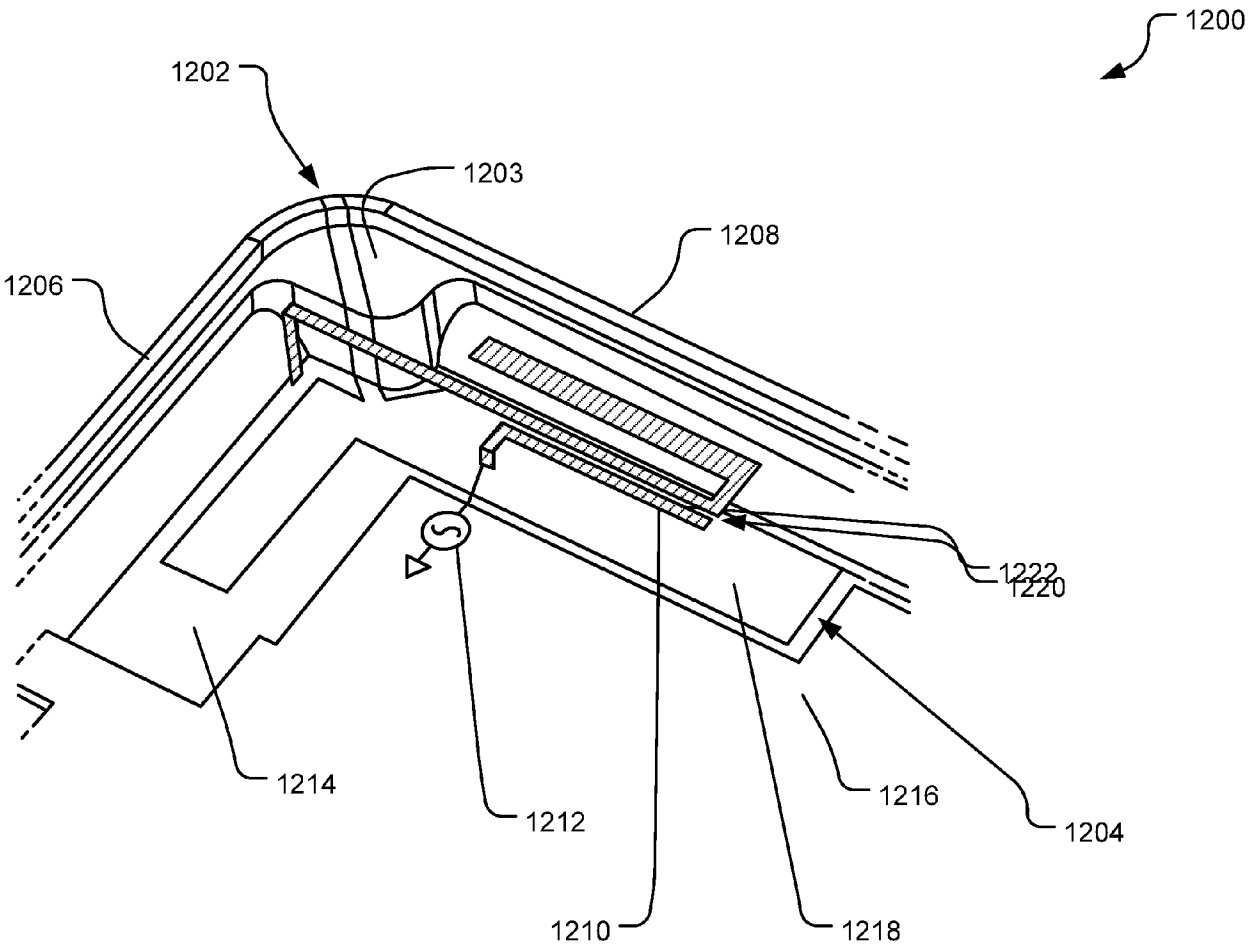
FIG. 12 illustrates an example L-shaped back face antenna assembly with a feed structure having capacitive coupling to another feed structure that is galvanically connected to a metal computing device case.

FIG. 12 illustrates an example L-shaped back face antenna assembly 1200 with a feed structure 1210 having capacitive coupling to another feed structure 1222 that is galvanically connected to a metal computing device case 1203. An L-shaped cut-out 1204 in a metal computing device case 1203 forms two elongated metal arms 1206 and 1208 along edges of the cut-out 1204 in combination with a notch 1202. The feed structure 1210 couples a radio 1212 to the back face 1214 via a capacitive coupling with the feed structure 1222. The feed structure 1222 has multiple branches to create multiple resonances at multiple frequencies or to enhance matching at certain frequencies. The feed structure 1210 is capacitively coupled to the feed structure 1122 across an insulating gap 1120.

Typically, the radio 1212 is mounted on a PCB 1216 within the metal computing device case 1203. The cut-out 1204 is filled with a plastic insert 1218. It should be understood that the insert may be made of other insulating materials (e.g., ceramics).

Figure 13:
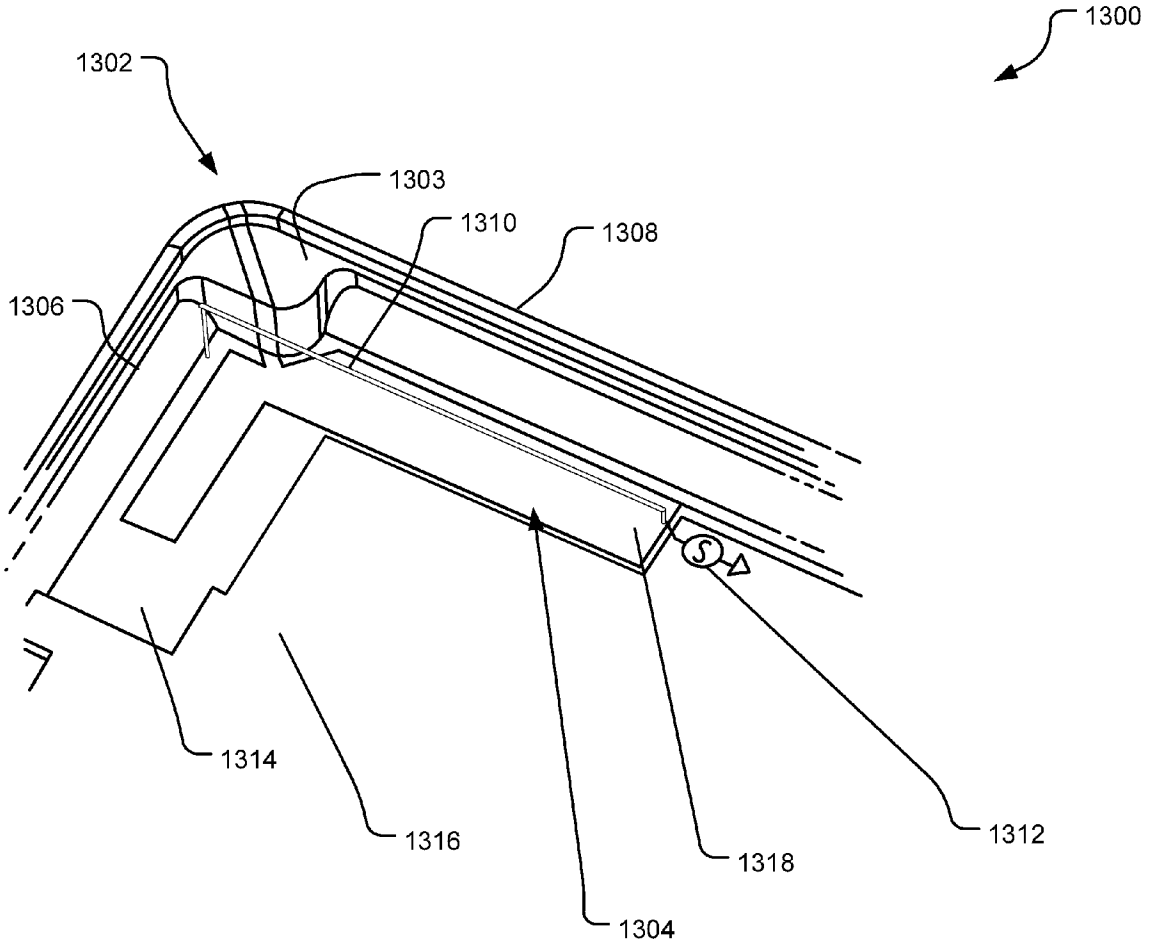
FIG. 13 illustrates an example L-shaped back face antenna assembly with a feed structure connected to a radio at an alternative location on a PCB.

FIG. 13 illustrates an example L-shaped back face antenna assembly 1300 with a feed structure 1310 connected to a radio 1312 at an alternative location on a PCB 1316. The feed structure 1310 connects the radio 1312 to one of two elongated metal arms 1306 and 1308 formed along the edges of an L-shaped cut-out 1304 in the back face 1314 of a metal computing device case 1303 in combination with the side face notch 1302. Typically, the radio 1312 is mounted on a PCB 1316 within the metal computing device case 1303. The cut-out 1304 is filled with a plastic insert 1318. It should be understood that the insert may be made of other insulating materials (e.g., ceramics). Alternative connection configurations may also be employed.

Figure 14:
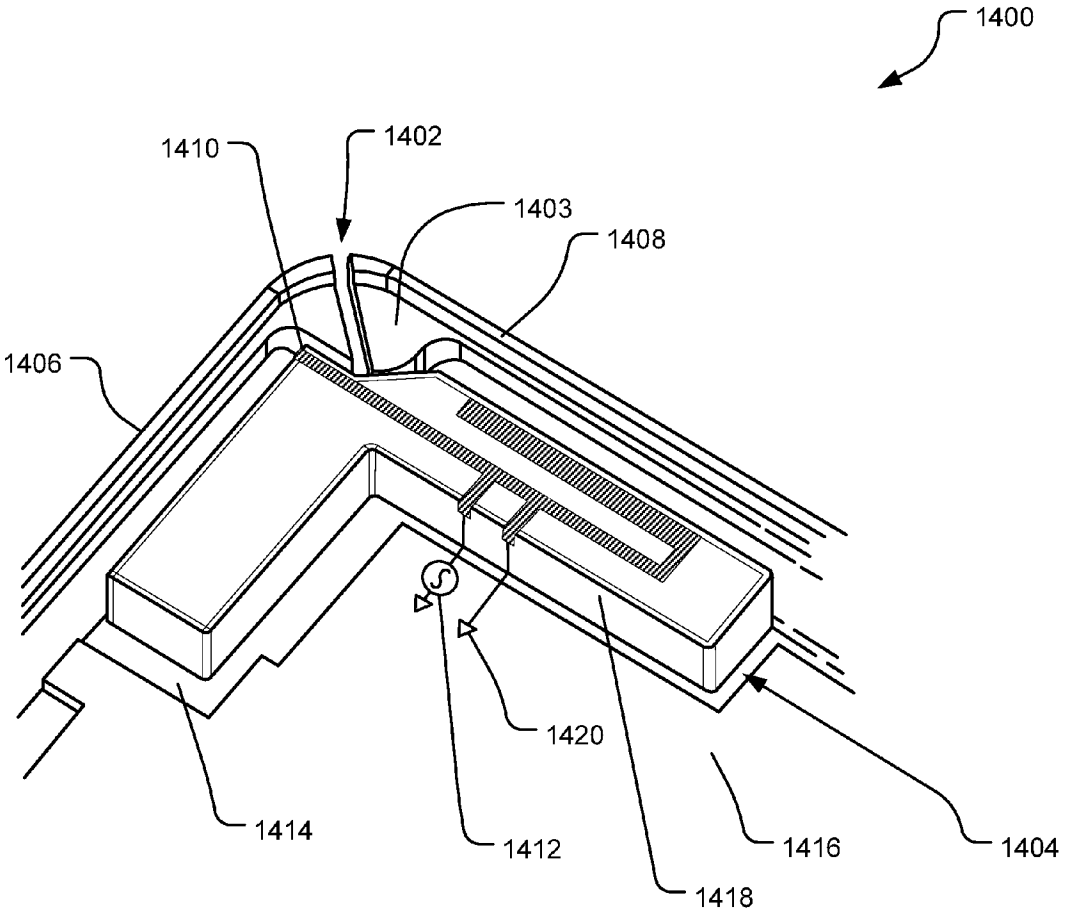
FIG. 14 illustrates an example L-shaped back face antenna assembly with a feed structure supported by a non-conductive carrier.

FIG. 14 illustrates an example L-shaped back face antenna assembly 1400 with a feed structure 1410 supported by a non-conductive carrier 1418. An L-shaped cut-out 1404 in the back face 1414 of a metal computing device case 1403 forms two elongated metal arms 1406 and 1408 along edges of the cut-out 1404 in combination with a notch 1402. The feed structure 1410 connects a radio 1412 to the back face 1414 of the metal computing device case 1403 and to a radio frequency ground 1420 (e.g., an electrically neutral potential) positioned next to the radio 1412. The feed structure 1410 has multiple branches to create multiple resonances at multiple frequencies or to enhance matching at certain frequencies. Typically, the radio 1412 is mounted on a PCB 1416 within the metal computing device case 1403.

Figure 15:
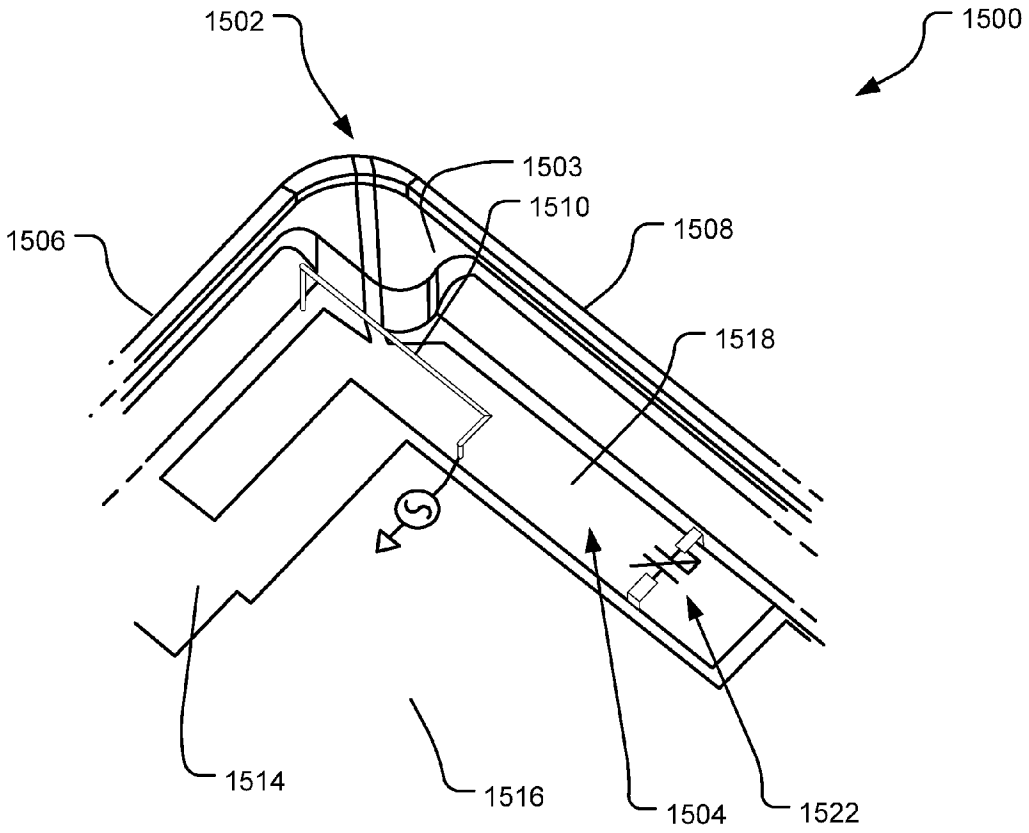
FIG. 15 illustrates an example L-shaped back face antenna assembly with an electronically variable component to change the electrical length of an antenna arm.

FIG. 15 illustrates an example L-shaped back face antenna assembly 1500 with an electronically variable component 1522 to change the electrical length of an antenna arm. Example electronically variable components may include without limitation a BST (barium strontium titanate) capacitor, a MEMS (micro-electromechanical systems) capacitor, and a radiofrequency (RF) switch that commutes between inductors and capacitors of different values, etc. A feed structure 1510 connects the radio 1512 to one of two elongated metal arms 1506 and 1508 formed along the edges of an L-shaped cut-out 1504 in the back face 1514 on a metal computing device case 1503 in combination with the side face notch 1502. Typically, the radio 1512 is mounted on a PCB 1516 within the metal computing device case 1503. Alternative connection configurations may also be employed. The cut-out 1504 is filled with a plastic insert 1518. It should be understood that the insert may be made of other insulating materials (e.g., ceramics).

In an alternative implementation, the insert 1518 may be made from a dielectric material having a dielectric constant that can be altered by applying a voltage to the insert 1518, thereby tuning the resonance frequency during operation of the computing device.

Figure 16B:
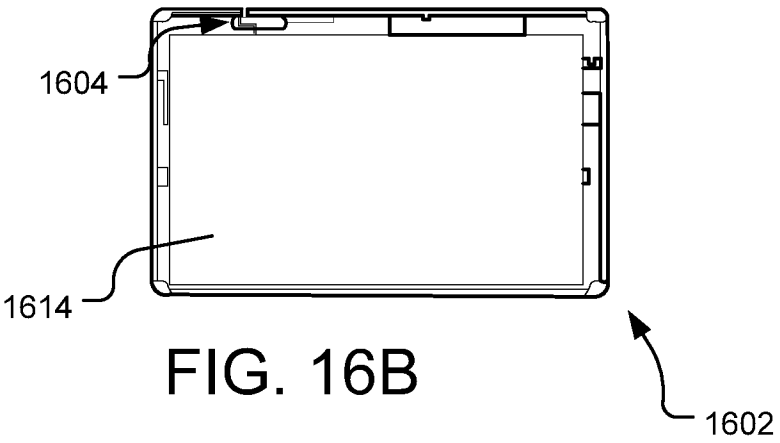
FIGS. 16A, 16B, and 16C illustrate an example back face antenna assembly spaced away from a corner of a metal computing device case.
Figure 16A:
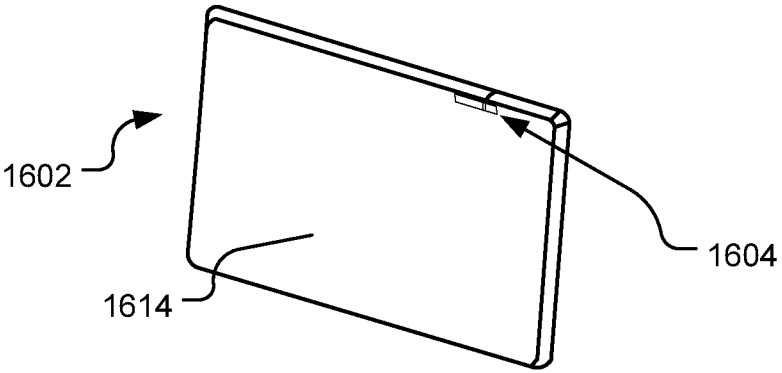
Figure 16C:
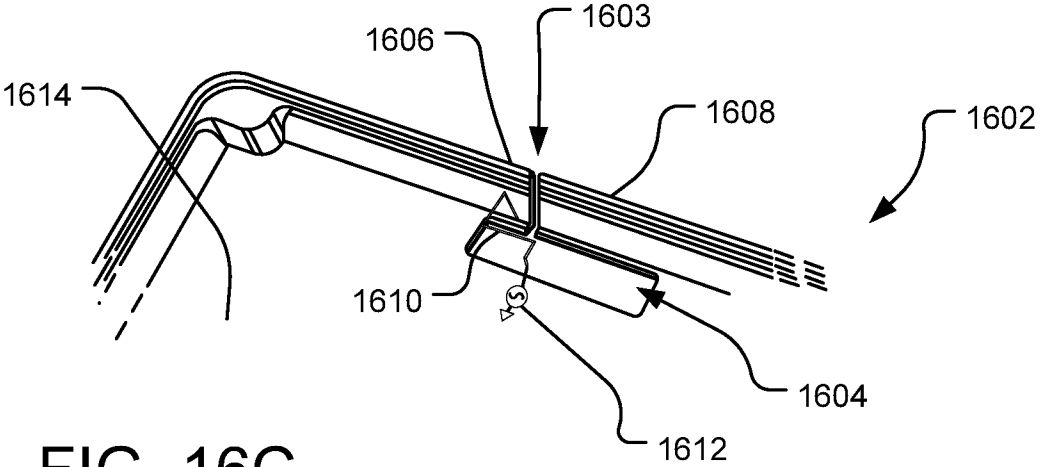

FIGS. 16A, 16B, and 16C illustrate an example back face antenna assembly 1604 spaced away from a corner of a metal computing device case 1602. A feed structure 1610 connects the radio 1612 to one of two metal arms 1606 and 1608 formed along the edges of a cut-out 1604 in the back face 1614 in combination with the side face notch 1603. Alternative connection configurations may also be employed.

Figure 17:
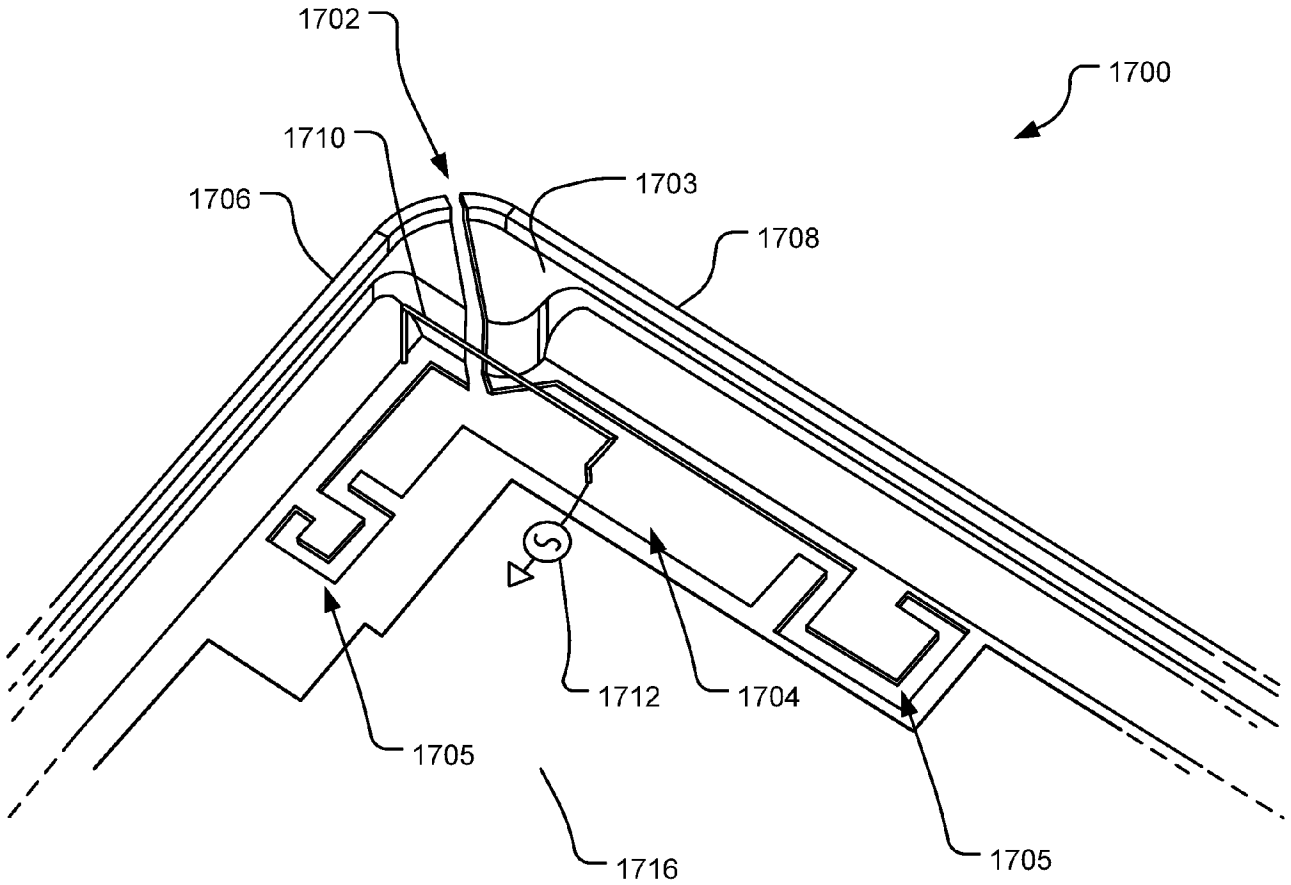
FIG. 17 illustrates an example L-shaped back face antenna assembly with elongated metal arms and meandering, routed cut-outs.

FIG. 17 illustrates an example L-shaped back face antenna assembly 1700 with elongated metal arms 1706 and 1708 and meandering, routed cut-outs 1705 in the back face 1714 of a metal computing device case 1703. The routed cut-outs 1705 provide a longer electrical length in a shorter portion of the cut-out 1704. The length of the cut-outs determines the resonant frequencies of the back face antenna assembly 1700. The feed structure 1710 connects the radio 1712 to one of two elongated metal arms 1706 and 1708 formed along the edges of an L-shaped cut-out 1704 in the back face 1714 in combination with the side face notch 1702. Typically, the radio 1712 is mounted on a PCB 1716 within the metal computing device case 1703. Alternative connection configurations may also be employed.

Figure 18:
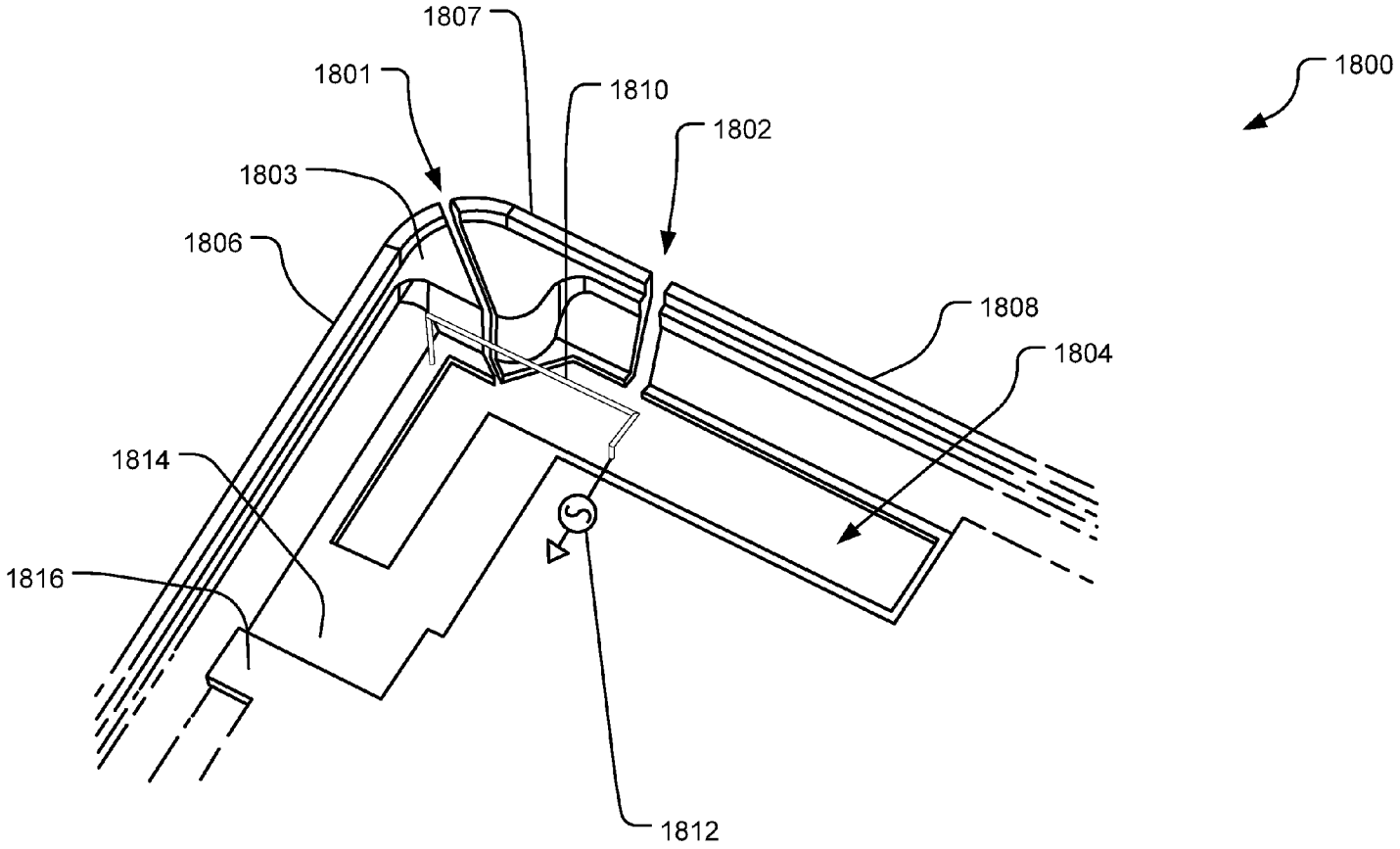
FIG. 18 illustrates an example L-shaped back face antenna assembly with a corner-located side face notch and a side-located side face notch in a metal computing device case.

FIG. 18 illustrates an example L-shaped back face antenna assembly 1800 with a corner-located side face notch 1801 and a side-located side face notch 1802 in a metal computing device case 1803. An L-shaped cut-out 1804 forms three elongated metal arms 1806, 1807, and 1808 along edges of the cut-out 1804 in combination with the notches 1801 and 1802. The locations and dimensions of the portions of the cut-out 1804, the notches 1801 and 1802, and the elongated metal arms 1806, 1807, and 1808 influence the resonance frequencies and impedance matching of the antenna assembly 1800, which are tunable at design time to support multiple frequency bands, operating conditions, and performance requirements. More than two notches and more than three elongated metal arms may be employed in various configurations.

A feed structure 1810 connects a radio 1812 to the back face 1814 of the metal computing device case 1803. Typically, the radio 1812 is mounted on a PCB 1816 within the metal computing device case 1803. It should be understood that the notches 1801 and 1802 may be formed in any side wall of the metal computing device case 1803 that provides access to the cut-out 1804.

Figure 19:
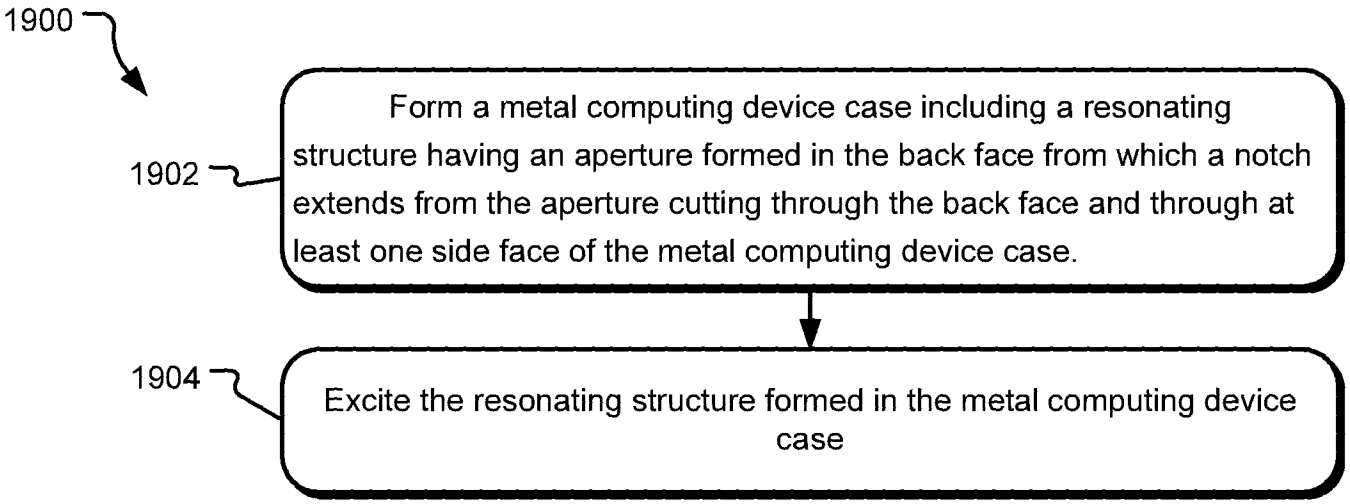
FIG. 19 illustrates example operations for using a back face antenna assembly.

FIG. 19 illustrates example operations 1900 for using a back face antenna assembly. A providing operation 1902 provides a metal computing device case including a back face and one or more side faces bounding at least a portion of the back face. The metal computing device case further includes a radiating structure having an aperture formed in the back face from which a notch extends from the aperture cutting through the back face and through at least one side face of the metal computing device case.

An exciting operation 1904 excites the radiating structure in the metal computing device case causing the radiating structure to resonate at one or more resonance frequencies over time.

Figure 20:
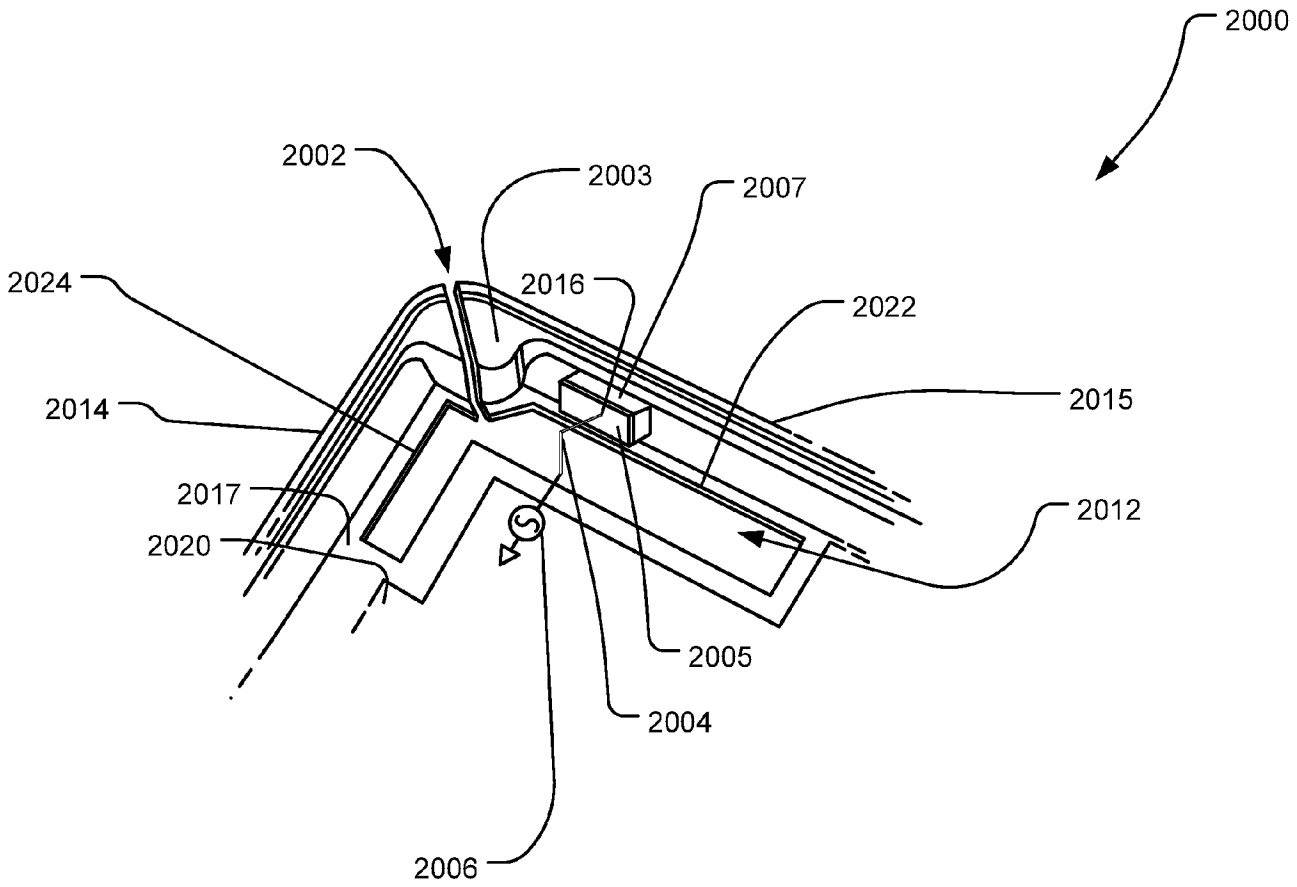
FIG. 20 illustrates an example L-shaped back face antenna assembly with a corner-located side face notch in a metal computing device case of a computing device.

FIG. 20 illustrates an example L-shaped back face antenna assembly 2000 with a corner-located side face notch 2002 in a metal computing device case 2003 of a computing device. A feed structure 2004, in the form of a conductive wire or strip, connects a radio 206 at a connection point 2016 to a metalized plate 2005 on a dielectric spacer block 2007. Typically the permittivity of the dielectric material is in the range 10 to 100, although this range may be broader in some applications. An elongated metal arm 2015 of the L-shaped side face antenna assembly 2000 is excited through the block of the insulating dielectric spacer block 2007, allowing an increase in the bandwidth of the L-shaped side face antenna assembly 2000.

The radio 2006 may be mounted on a printed circuit board 2020 (PCB) affixed to the back face 2017 of the metal computing device case 2003. Alternative connection configurations may also be employed (e.g., a connection to the other elongated metal arm). The notch 2002 and the cut-out 2012 may be filled with a plastic layer or other insulating material (e.g., a ceramic) (not shown).

The cut-out 2012, the notch 2002, and the elongated metal arms 2014 and 2015 operate as radiating structures of the antenna assembly 2000. The dimensions of the cut-out sections influence the impedance matching for different radiofrequency bands. For example, the length of the cut-out section 2022 provides a lower resonant frequency than the length of the cut-out section 2024, thereby providing at least two radiofrequency bands supported by the antenna assembly 200. Likewise, the size and shape of the conductive feed structure 2004 influences the resonance frequencies of the antenna assembly 2000, especially when operated at higher frequencies as provided by the radio 2006, as well as the impedance matching at the different radiofrequency bands.

It should be understood that other slot shapes may be employed. For example, the slot in FIG. 16 may be expanded to include an orthogonal slot connected into another slot parallel to the original slot. Slots may have irregular and/or irregular shapes. For example, slots may be shaped to follow the curves of a rounded corner or other feature of a metal computing device case. Accordingly, slot configurations should not be limited to those illustrated in the example implementations.

The above specification, examples, and data provide a complete description of the structure and use of exemplary implementations. Since many implementations can be made without departing from the spirit and scope of the claimed invention, the claims hereinafter appended define the invention. Furthermore, structural features of the different examples may be combined in yet another implementation without departing from the recited claims.

What is claimed is:

1. An antenna assembly comprising:

a metal computing device case including a back face and one or more side faces bounding at least a portion of the back face, the metal computing device case including a radiating structure having an aperture formed in the back face from which a notch extends from the aperture cutting through the back face and through at least one side face of the metal computing device case.

2. The antenna assembly of claim 1 wherein the radiating structure further comprises:

one or more portions of the metal computing device case forming antenna arms proximal to the aperture.

3. The antenna assembly of claim 1 wherein the radiating structure further includes at least two portions of one of the side faces of the metal computing device case forming antenna arms separated by the notch.

4. The antenna assembly of claim 1 wherein the radiating structure further includes two side faces of the metal computing device case forming antenna arms separated by the notch.

5. The antenna assembly of claim 1 further comprising:

a conductive feed structure coupled to a radio, the conductive feed structure being positioned proximal to the radiating structure of the metal computing device case and configured to excite the radiating structure at one or more resonance frequencies.

6. The antenna assembly of claim 5 wherein the conductive feed structure includes at least two conductive feed elements, wherein one conductive feed element is capacitively coupled to the other conductive feed element.

7. The antenna assembly of claim 5 wherein the conductive feed is electrically connected to a neutral potential.

8. The antenna assembly of claim 5 wherein the conductive feed structure galvanically connects the radio to the metal computing device case.

9. The antenna assembly of claim 5 wherein the conductive feed structure capacitively couples the radio to the metal computing device case.

10. The antenna assembly of claim 5 wherein the conductive feed structure capacitively couples the radio to the metal computing device case through a dielectric spacer.

11. The antenna assembly of claim 1 wherein a second notch extends from the aperture cutting through the back face and through at least one side face of the metal computing device case.

12. The antenna assembly of claim 1 further comprising:

an electronically variable component positioned at the aperture to change the electrical length of an antenna arm formed from a portion of the metal computing device case proximal to the aperture.

13. The antenna assembly of claim 12 wherein the electronically variable component includes a dielectric material having a voltage-dependent dielectric constant.

14. The antenna assembly of claim 13 wherein the dielectric material forms an insert filling the aperture.

15. The antenna assembly of claim 1 wherein the aperture is formed from at least one meandering routed cut-out in the back face of the metal computing device case.

16. A method comprising:

forming a metal computing device case including a back face and one or more side faces bounding at least a portion of the back face, the metal computing device case including a radiating structure having an aperture formed in the back face from which a notch extends from the aperture cutting through the back face and through at least one side face of the metal computing device case.

17. The method of claim 16 wherein the radiating structure further includes one or more portions of the metal computing device case proximal to the aperture.

18. The method of claim 16 wherein the radiating structure further includes at least two portions of one of the side faces of the metal computing device case separated by the notch.

19. The method of claim 16 further comprising:

providing a conductive feed structure connected to a radio, the conductive feed structure being positioned proximal to the radiating structure of the metal computing device case and configured to excite the radiating structure at one or more resonance frequencies.

20. A method comprising:

exciting a radiating structure formed in a metal computing device case, the metal computing device case including a back face and one or more side faces bounding at least a portion of the back face, the radiating structure including an aperture formed in the back face from which a notch extends from the aperture cutting through the back face and through at least one side face of the metal computing device case.

* * * * *